US011518005B2

(12) United States Patent
Woodman, III et al.

(10) Patent No.: US 11,518,005 B2
(45) Date of Patent: Dec. 6, 2022

(54) APPARATUS FOR ENGAGING A GUIDE PIN

(71) Applicant: BAE Systems Information and Electronic Systems Integration Inc., Nashua, NH (US)

(72) Inventors: Wallace E. Woodman, III, Merrimack, NH (US); Earle R. Box, Jr., Londonderry, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 1029 days.

(21) Appl. No.: 16/217,946

(22) Filed: Dec. 12, 2018

(65) Prior Publication Data

US 2019/0176298 A1 Jun. 13, 2019

Related U.S. Application Data

(60) Provisional application No. 62/597,828, filed on Dec. 12, 2017.

(51) Int. Cl.

| | |
|---|---|
| ***B25B 13/08*** | (2006.01) |
| ***H01R 13/631*** | (2006.01) |
| ***H01R 13/24*** | (2006.01) |
| ***B25B 13/10*** | (2006.01) |
| ***H01R 43/22*** | (2006.01) |
| ***B25B 27/04*** | (2006.01) |

(52) U.S. Cl.

CPC ..... *B25B 13/08* (2013.01); *B25B 13/10* (2013.01); *B25B 27/04* (2013.01); *H01R 13/2421* (2013.01); *H01R 13/631* (2013.01); *H01R 43/22* (2013.01)

(58) Field of Classification Search

CPC ..... B25B 13/08; B25B 13/10; H01R 13/2421; H01R 13/631

USPC ..... 81/119

See application file for complete search history.

(56) References Cited

U.S. PATENT DOCUMENTS

| | | | | |
|---|---|---|---|---|
| 4,425,704 | A * | 1/1984 | Cline | H01R 43/00 29/426.6 |
| 4,575,143 | A * | 3/1986 | Nast | B25J 1/04 294/24 |
| 5,407,243 | A * | 4/1995 | Riemann | A61B 17/50 294/100 |
| 6,363,560 | B1 * | 4/2002 | Kesinger | H01R 43/042 7/138 |
| 7,017,259 | B2 * | 3/2006 | Aoki | H01R 12/585 29/739 |
| 7,020,376 | B1 * | 3/2006 | Dang | B25B 9/02 385/135 |
| 7,257,888 | B2 * | 8/2007 | Nelson | H01R 43/26 29/739 |
| 7,690,925 | B2 * | 4/2010 | Goodman | H01R 13/2421 439/70 |
| 7,813,142 | B2 * | 10/2010 | Lin | H05K 1/0215 361/791 |

(Continued)

*Primary Examiner* — Alexander Gilman
(74) *Attorney, Agent, or Firm* — Sarah Birdie Kim

(57) ABSTRACT

Apparatus and method are disclosed for engaging a guide pin for installation or removal. The tool has a housing with a plunger positioned within the housing. A support tube has at least two extensions that protrude from the housing when an engagement mechanism is depressed and grips the guide pin when the engagement mechanism is released.

14 Claims, 16 Drawing Sheets

(56) References Cited

U.S. PATENT DOCUMENTS

| | | | | |
|---|---|---|---|---|
| 7,941,914 | B2 * | 5/2011 | Castiglione | H01R 43/22 29/426.6 |
| 7,951,168 | B2 * | 5/2011 | Chao | A61B 17/708 606/246 |
| 8,066,536 | B2 * | 11/2011 | Chen | H01R 13/2421 439/824 |
| 8,104,806 | B1 * | 1/2012 | Shih | B25J 1/02 294/120 |
| 8,122,900 | B1 * | 2/2012 | Hayes | A45B 3/00 135/66 |
| 8,485,070 | B2 * | 7/2013 | Darbinyan | B25B 13/28 81/90.1 |
| 9,722,382 | B2 * | 8/2017 | Goodman | H01R 43/22 |
| 10,109,975 | B2 * | 10/2018 | Eagle | H01R 43/205 |
| 10,230,207 | B2 * | 3/2019 | Krupp | H05K 13/0491 |
| 10,615,559 | B2 * | 4/2020 | Owen | B25B 9/02 |
| 10,971,857 | B2 * | 4/2021 | Nguyen | H01R 13/6335 |
| 11,112,566 | B2 * | 9/2021 | Takano | G02B 6/3878 |
| 11,189,945 | B2 * | 11/2021 | Koshiishi | H01R 12/718 |
| 2009/0023311 | A1 * | 1/2009 | Goodman | H01R 13/2421 439/66 |
| 2013/0263444 | A1 * | 10/2013 | Lo | B25B 9/00 81/487 |
| 2014/0366355 | A1 * | 12/2014 | Goodman | H01R 13/426 29/764 |
| 2018/0120513 | A1 * | 5/2018 | Conrad | G02B 6/3898 |
| 2018/0159289 | A1 * | 6/2018 | Krupp | H01R 43/26 |

* cited by examiner

APPARATUS FOR ENGAGING A GUIDE PIN

CROSS-REFERENCE TO RELATED APPLICATIONS

This application claims the benefit of U.S. Provisional Patent Application Ser. No. 62/597,828, filed on Dec. 12, 2017, and entitled "Apparatus for Engaging a Guide Pin," which is herein incorporated by reference in its entirety.

STATEMENT OF GOVERNMENT INTEREST

This invention was made with United States Government support under Contract No. 6500001451 awarded by the Air Force. The United States Government has certain rights in the inventions.

FIELD

The following disclosure relates generally to a tool for engaging with a guide pin in a connector assembly, more particularly a shell guide pin torque tool used to attach or replace a guide pin to a connector assembly.

BACKGROUND

Tightening or loosening a guide pin in a connector assembly requires tools that can easily operate in small, confined spaces. Current tools are generally unable to fit into such small, confined spaces in order to engage and torque the guide pin into the connector. Additionally, current tools used to tighten or loosen guide pins can potentially damage the guide pin in the course of clamping it by scratching the gold or other metal plating. Damaging the guide pins in this way can lead to costly repairs and potentially replacing the connector in its entirety. Therefore, there is a need for a tool that can operate in such small, confined spaces while applying a relatively large amount of torque to the guide pin without damaging it.

SUMMARY

An embodiment of the present disclosure provides an apparatus for engaging a guide pin. A housing with a hollow interior has a plunger positioned within the housing. A support tube with two or more extensions slides around a first end of the plunger. In one example an engagement mechanism is coupled with a second end of the plunger. There may be at least two contacts affixed to the extensions.

Particular implementations may include one or more of the following features. There may be a compression spring wrapped around the support tube/plunger. There may be a coiled spring pin going laterally through the aperture of the plunger, where the coiled spring is configured to engage with the compression spring. The housing may also contain a groove located inside the housing, where the coiled spring pin sits within the groove. Additionally, there may be a retainer clip around the second end of the plunger. The second end of the plunger may have a curved stop, where the curved stop hits a top end of a guide pin. In one example the support tube is 0.005 inches in diameter. The contacts may have a self-releasing taper angle of about eight degrees. The apparatus may be configured for use with torque wrenches or drivers.

Another example embodiment provides an apparatus for engaging a guide pin and torqueing it into a connector assembly comprising a housing. The housing may contain a groove located inside the housing. There may also be a plunger positioned within the housing, wherein the plunger has an aperture. There may be a compression spring around the support tube and a portion of the plunger, wherein the compression spring contacts a face of the plunger. Additionally, a coiled spring pin may thread laterally through the aperture of the plunger, where the coiled spring pin is configured to engage with the compression spring. The coiled spring pin may sit within the groove located inside the housing. A first end of the plunger fits within the support tube in one example, where the support tube has two or more extensions on one end for engaging with the pin. A button may couple with a second end of the plunger, where the button is configured to engage with the plunger. The second end of the plunger may have a retainer clip around the second end of the plunger. At least two contacts may be affixed to an end of the extensions, wherein the at least two contacts may have a self-releasing taper angle that in one example is about of eight degrees.

Particular implementations may include one or more of the following features. The support tube may be 0.005 inches in diameter. The apparatus may be configured for use with standard torque wrenches or drivers.

Implementations of the techniques discussed above may include a method or process, a system or apparatus, a kit, or a computer software stored on a computer-accessible medium. The details or one or more implementations are set forth in the accompanying drawings and the description below. Other features will be apparent from the description and drawings, and form the claims.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

These and other features of the present embodiments will be understood better by reading the following detailed description, taken together with the figures herein described. The accompanying drawings are not intended to be drawn to scale. For purposes of clarity, not every component may be labeled in every drawing.

DETAILED DESCRIPTION

This disclosure relates to an apparatus for engaging a guide pin that includes a housing and a plunger positioned within the housing. The plunger may have an aperture as well as a first end and a second end. A support tube may surround the first end, and an engagement mechanism may couple with the second end. There are two or more extensions on one end of the support tube for engaging the pin. Additionally, there may be at least two contacts affixed to the extensions.

Previously, guide pins were designed to attach to connectors and could not typically be sufficiently tightened to the proper torque with existing torque tools. These guide pins could loosen over the course of producing and installing the connector assemblies or through use of the product in the field. Existing tools do not easily and safely engage the guide pin to torque it into the connector. Additionally, existing tools tend to damage the metal plating on the guide pins, thereby affecting the quality of the guide pins that could affect signal integrity.

Thus, and in accordance with an embodiment of the present system, techniques and architecture are disclosed for an apparatus for engaging a guide pin. The present tool allows for installing guide pins that is small enough to engage the guide pins in a very confined space that could still withstand hundreds of pounds of force. The tool is able to go over the guide pin and clamp onto it without damaging the metal plating. The tool housing contains a plunger interiorly disposed in the housing, a support tube, a compression spring, and a coiled spring pin. The plunger may be centrally positioned within the housing and may have a first end and a second end. The plunger may also have an aperture that runs through it and the support tube, and the coiled spring pin may run through that aperture. The support tube may encase the first end of the plunger.

Figure 1:
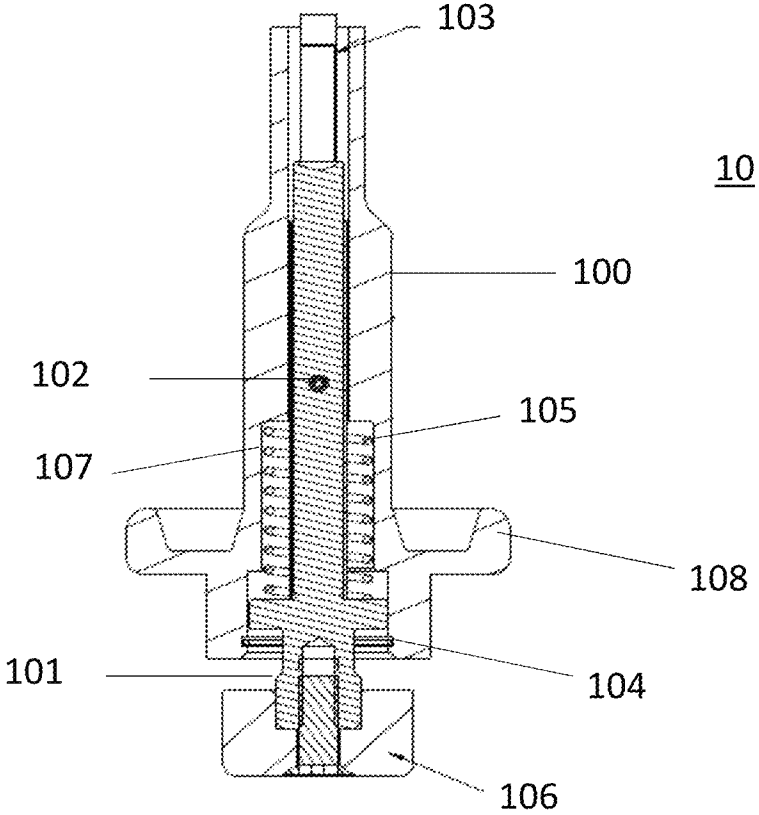
FIG. 1 is a cut-away side perspective view of the apparatus, according to one embodiment.
Figure 2:
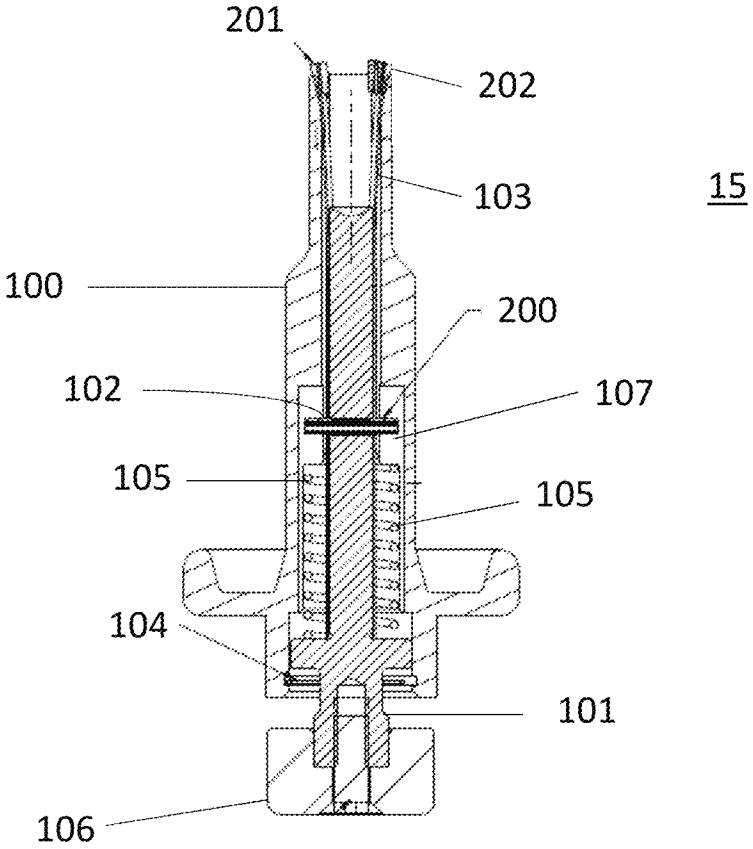
FIG. 2 is another cut-away side perspective view of the apparatus, according to an embodiment.

FIGS. 1 and 2 are perspective views of an apparatus for engaging a guide pin configured in accordance with an embodiment of the present disclosure. In one example, the apparatus may be configured to work with a guide pin having a diameter of 0.113 inches, which is one of several standard dimensions. This tool in one design was specifically configured to work in a very confined space surrounding the guide pin, which in one example was only about 0.210 inches wide and operated with only 0.049 inches of space between the contact and the connector walls. The tool had to open up when installing it over the guide pin sufficiently to not mar the gold plating on the guide pin and then had to be strong enough to be able apply generous torque to the guide pin. This required the ability to withstand hundreds of pounds of force applied to the guide pin flats and not open or spread, yet, easily release with a gentle push on the release button. The use of a self-releasing taper angle to wedge the contacts against the flats provided enough outward motion to clear the guide pin for release, and apply the required force and be locked, and sufficient travel inward to grip the flats. The design of the tool in this example also considers possible damage to the delicate parts which are required with only the 0.049" inch of working space and be able to have a gentle release force as the metal tube that pushed the contacts could be 0.005 inches thick and might buckle. For example, the release mechanism can release with a gentle 3-6 lb push on the release button. The design of the tool in one example constrained the small size tube between the housing and a mandrel with minimal clearance to prevent buckling. The travel range of the fingers/contacts was limited in one design to prevent damage or bending when exposed in its released position. An inner mandrel/post was dimensioned and radiused in one example to prevent the operator to be able to open the tool and push it too far against the connector body, bending the contact supports. In one example the radius shape of this mandrel matches the radiused tip of the guide pin as to minimize the normal forces exerted onto the guide pin, further preventing damage to the gold plating as the contacts could slide out beyond the tip of the housing and be susceptible to damage. The apparatus can be scaled to work with guide pins of different diameters such as larger guide pins using a larger tool.

Figure 10A:
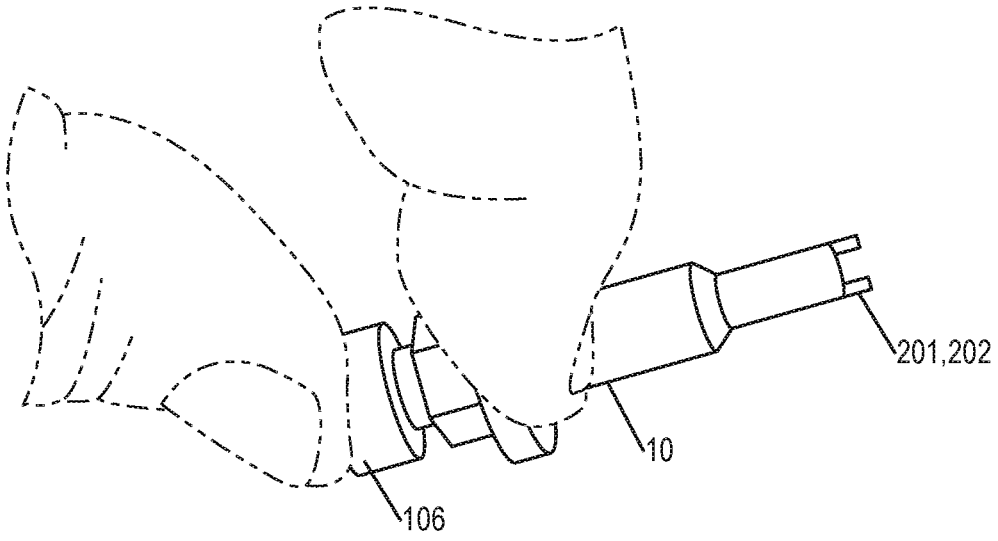
FIG. 10A is an image of the apparatus held by a user, according to an embodiment.
Figure 10B:
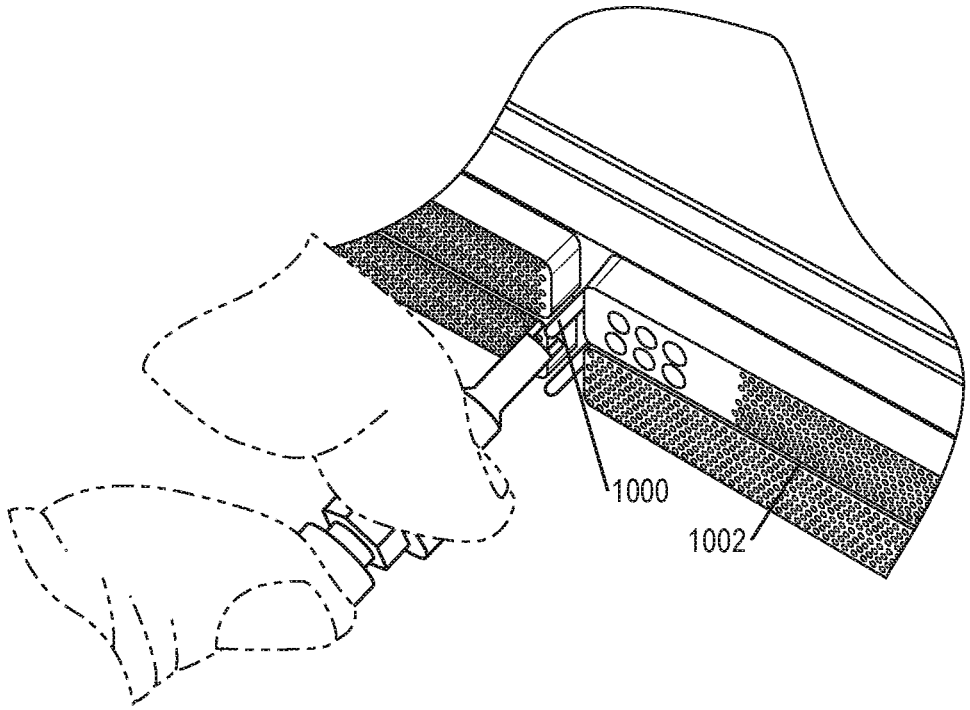
FIG. 10B is an image of the operation of the apparatus by a user, according to an embodiment.

In FIG. 1, the apparatus 10 includes a housing 100 that contains a support tube 103 and a plunger 101. The housing 100 may be created from selective laser sintering or other manufacturing processes. In one example the plunger 101 is a one continuous piece of metal, such as stainless steel. The plunger 101 may also be made from titanium and other comparable metals or materials having similar pliability and characteristics. An engagement mechanism or button 106 is coupled to the plunger 101 allowing for pressing or engaging the plunger 101. The button can be integrally formed. The apparatus 10 may include an extended or gripping section 108 used for holding the apparatus during operation such as illustrated in FIG. 10A and FIG. 10B. In one example, the support tube 103 may have a diameter of about 0.005 inches. Additionally, the plunger 101 may have an aperture 102. The aperture 102 may laterally extend through the plunger 101, thereby creating a passage from one side of the plunger 101 to the other. In one embodiment, the aperture 102 may also laterally extend through the support tube 103, thereby creating a passage from one side of the support tube 103 to the other. This may allow the aperture 102 to create a passage that lines up between the support tube 103 and the plunger 101.

Alternative embodiments of the apparatus 10 may include a retainer clip 104. The retainer clip 104 is configured prevent the plunger 101 from coming out too far when it is released, thereby keeping the plunger 101 within the housing 100. The shape of the portion of the plunger 101 adjacent to the retainer clip 104 may also help prevent the plunger 101 from coming out of the housing 100. A spring 105 is retained within the slot or chamber 107 and maintains pressure on the plunger 101. Alternative embodiments of this apparatus may be scaled up to any size required to fit larger guide pins. This apparatus may be used with Amphenol connectors to tighten and loosen the guide pins. These examples are not meant to be limiting in any way. Those skilled in the art will recognize that this apparatus may be used with other connectors and may be scaled to different sizes in order to be compatible with different configurations.

In FIG. 2, the apparatus 15 comprises the support tube 103 and contacts 201, 202 secured to the end of the support tube 103. The contacts 201, 202 may be secured to the end of the support tube 103 by welding. Those skilled in the art will recognize that the contacts 201, 202 may be secured by some technique other than welding and can also be integral if additively manufactured. A coiled spring pin 200 may run through the aperture 102 of the plunger 101. In one embodiment, the aperture 102 may also laterally extend through the support tube 103, thereby creating a passage from one side of the support tube 103 to the other. This may allow the aperture 102 to create a passage that lines up between the support tube 103 and the plunger 101, thereby allowing the coiled spring pin 200 to keep the support tube 103 and the plunger 101 aligned.

In FIG. 2, a compression spring 105 may wrap around the plunger 101, allowing the compression spring 105 to interact with the coiled spring pin 200. This interaction may occur when the engagement mechanism 106, which is connected to the plunger 101, causes the plunger 101 to compress the compression spring 105 against the coiled spring pin 200. Alternative embodiments may include a retainer clip 104, which may help prevent the plunger 101 from coming out too far when it is released. The shape of the portion of the plunger 101 adjacent to the retainer clip 104 may prevent the plunger from coming out of the housing 100.

Figure 3A:
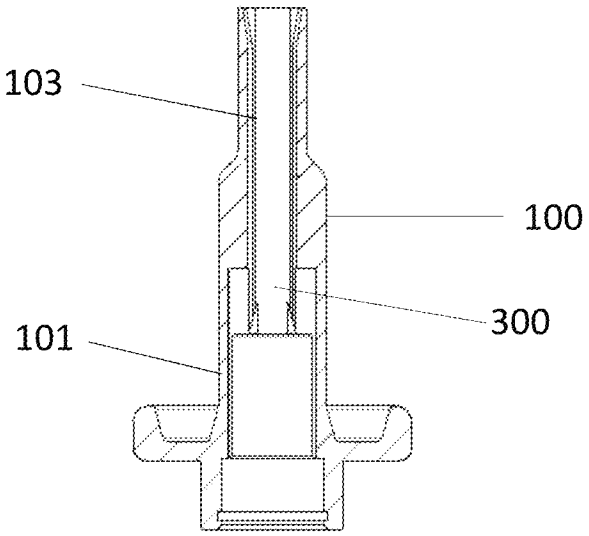
FIGS. 3A and 3B are perspective views of the housing portion of the apparatus, according to an embodiment.
Figure 3B:
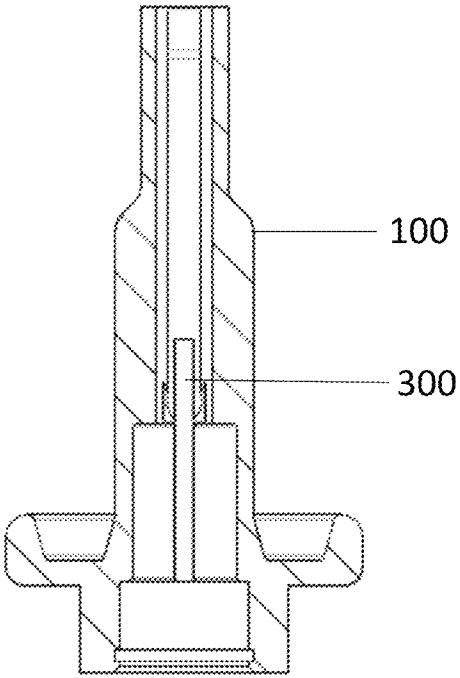

FIGS. 3A and 3B are perspective views of the housing 100. FIGS. 3A and 3B show where the support tube 103 and plunger 101 would be situated within the housing 100. The plunger 101 and the support tube 103 fit within the housing 100. The housing 100 may have a hexagonal shape to one of its ends, thereby allowing a standard torque wrench to grip the housing 100. The housing 100 may also include a groove 300 in which the coiled spring pin 200 sits. This groove 300 may prevent unwanted rotation of the plunger 101 and the support tube 103.

Figure 4A:
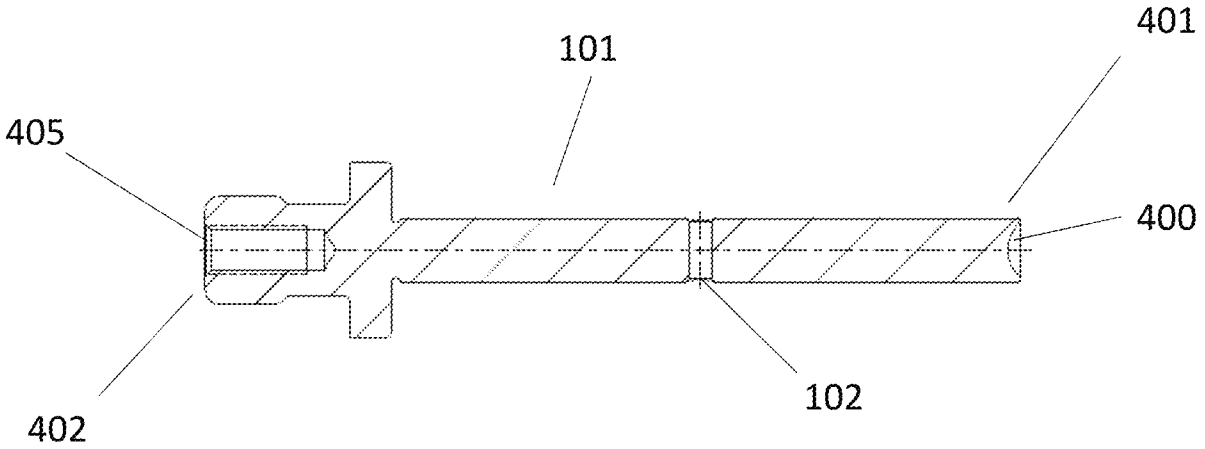
FIGS. 4A and 4B are perspective views of the plunger portion of the apparatus, according to an embodiment.
Figure 4B:
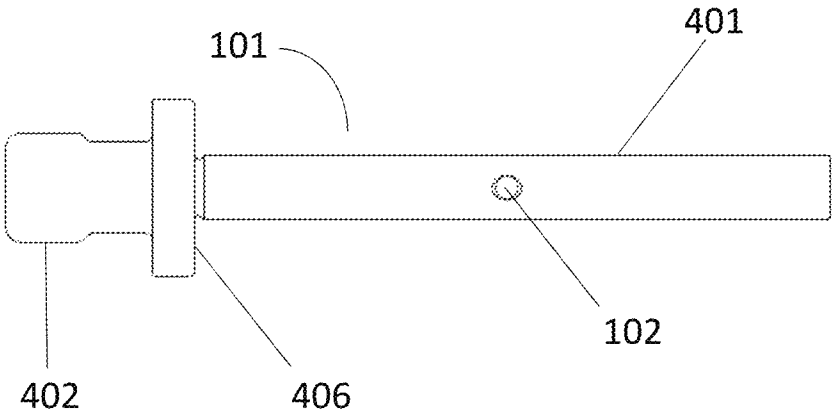

FIGS. 4A and 4B are perspective views of the plunger 101 component of the apparatus. In FIG. 4A, the plunger 101 may have a first end 401 and a second end 402. The plunger 101 may have a curved stop 400 at the first end 401 of the plunger 101. This curved stop 400 may be configured to match the shape of the head of the guide pin and may prevent the support tube 103 from buckling due to excessive applied force. The curved stop 400 in one example makes direct contact with the head of the guide pin. This curved stop 400 may also prevent the plunger 101 from extending too far over the guide pin. In FIGS. 4A and 4B, the aperture 102 may laterally run through the plunger 101, thereby allowing the coiled spring pin 200 to pass through the plunger 101. The second end 402 can have an opening 405 that is adapatable to secure the button. In one example the compression spring goes around the support tube and a portion of the plunger and is in contact with an extended section 406 of the plunger 101 such that the extended sections or face 406 compresses the compression spring when the button is depressed.

Figure 5B:
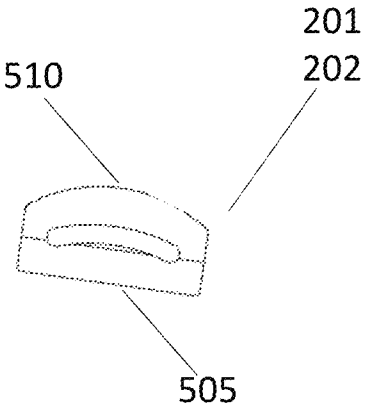
FIGS. 5A and 5B are perspective views of the contacts, according to an embodiment.
Figure 5A:
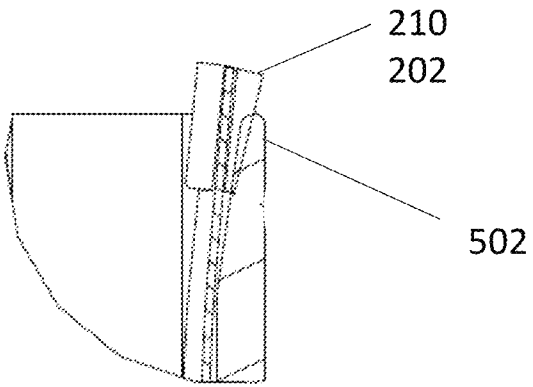

FIGS. 5A and 5B are perspective views of the contacts 201, 202 that attach to the end of the support tube 103. The contacts 201, 202 may be laser welded onto the ends of the support tube 103. The contacts 201, 202 may be affixed in a manner that provides a thinner end of the contact 201, 202 toward the coiled spring pin 200. The contacts 201, 202 in one example are affixed to the ends of the support tube 103, ensuring that the thinner ends of the contacts 201, 202 are oriented towards the compression spring 105. The contacts 201, 202 may have self-releasing taper angle of approximately eight degrees, which provides enough outward motion to clear the guide pin for release. The contacts 201, 202 may allow the apparatus to engage with and grip the flats of the guide pin. These flats may be inboard of the guide pin diameter. The self-releasing taper angle may also allow the apparatus to apply the required force and lock while providing sufficient travel inward to grip the guide pin. This taper angle may prevent the contacts 201, 202 and the support tube 103 from sticking to the end of the housing 100 that engages with the guide pin. In one example the end of the housing 100 includes a tapered and rounded section 502 that allows the support tube and contacts to smoothly retract and deploy. The contacts 201, 202 in one example has an interior flat surface 505 for engaging the pin and an exterior rounded surface 510 that allow for smoother deployment and retraction within the housing.

Figure 6A:
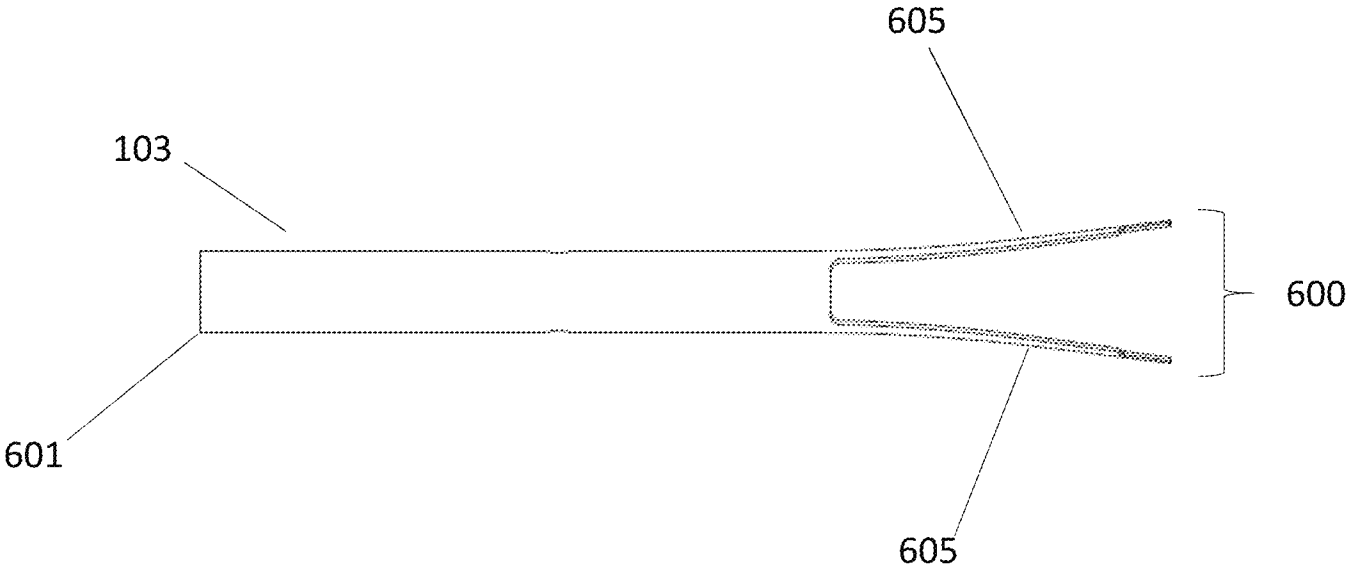
FIGS. 6A and 6B are perspective views of the support tube, according to an embodiment.
Figure 6B:
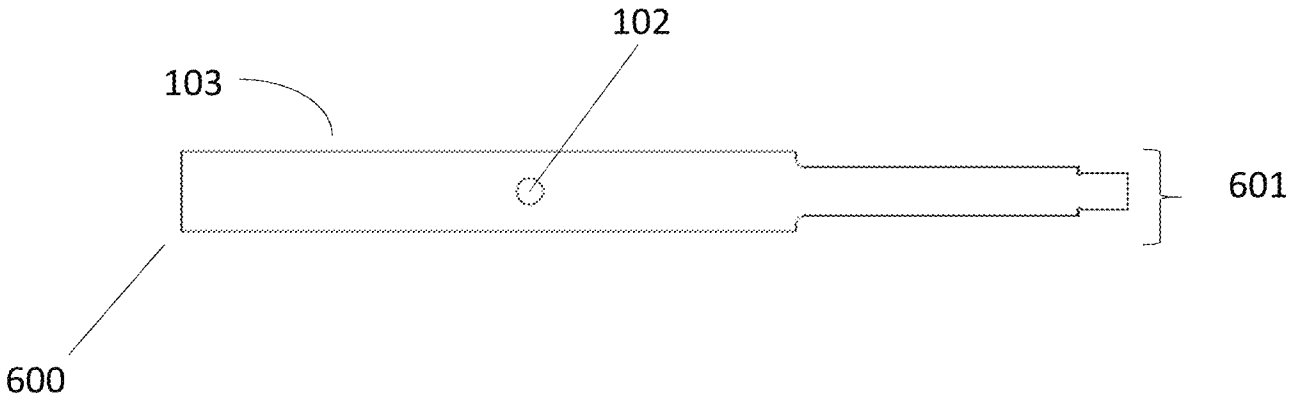

FIGS. 6A and 6B are perspective views of the support tube 103. FIG. 6A shows a support tube 103 having a first end 600 having two or more legs or extended portions 605 to which the contacts 201, 202 may be attached. The support tube 103 may have a second end 601, which would face towards the engagement mechanism 106. FIG. 6B shows the aperture 102 running laterally through the support 103, thereby allowing a coiled spring pin 200 to sit within the aperture 102. The first end 600 includes two or more legs or extension 605 that are formed with a memory shape to have s force to extend apart from each other in an outward direction. The length of the legs 605 are sufficient to extend from the tube 103 and engage with the pin.

Figure 7A:
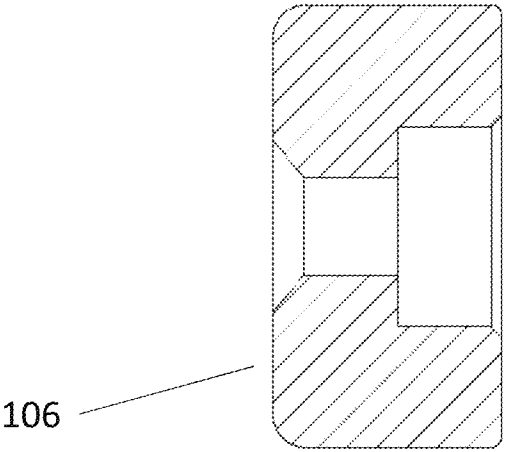
FIGS. 7A and 7B are perspective views of the engagement mechanism, according to an embodiment.
Figure 7B:
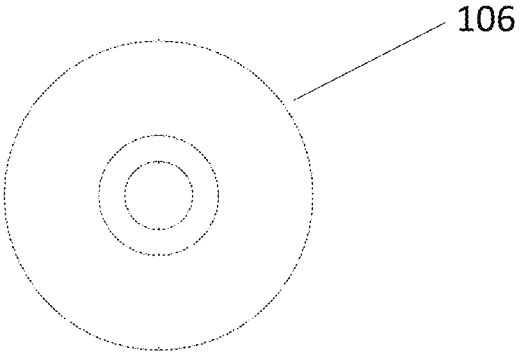

FIGS. 7A and 7B are perspective views of the engagement mechanism 106 of the apparatus. In one embodiment, the engagement mechanism 106 may be a button. The engagement mechanism 106 may allow the plunger 101 to interact with the support tube 103 in order to grip the guide pin in a connector assembly.

Figure 8:
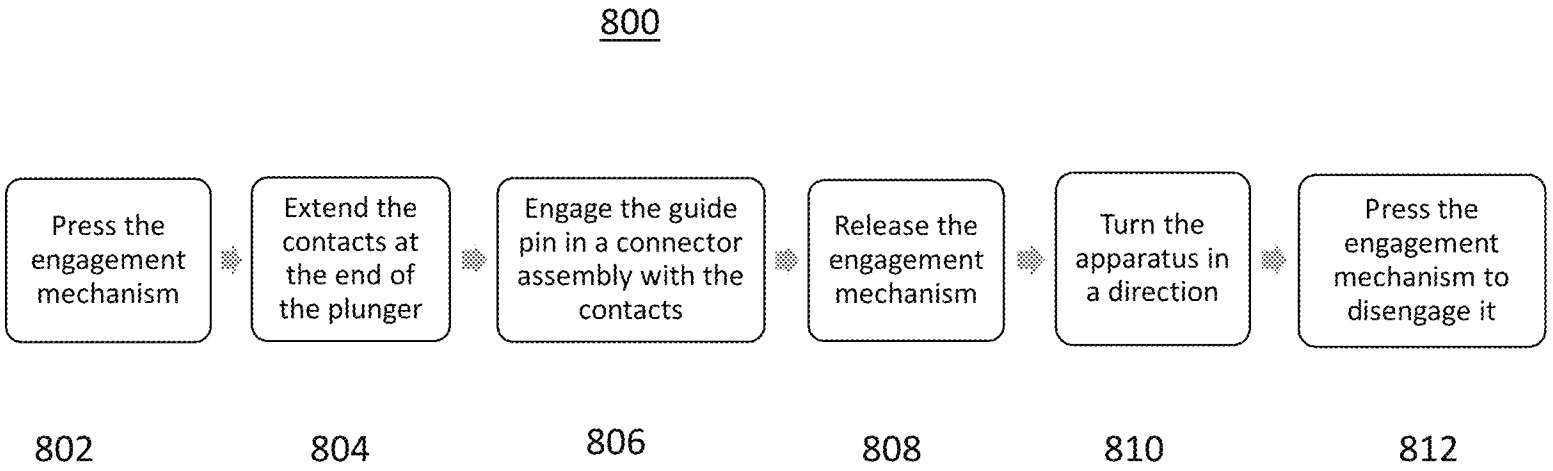
FIG. 8 is a flow chart of the operation of the apparatus, according to an embodiment.

Referring to FIG. 8, one embodiment of the method of operation 800 using the apparatus with a guide pin in a connector assembly is illustrated. The tool is selected according to the connector size, which in many cases is a standard size connector. The tool can come in multiple sizes to engage different sized connectors. A method for using the apparatus includes pressing the engagement mechanism to activate and engage the compression spring wrapped around the plunger 802. The method also includes extending the contacts at the end of the plunger 804 and engaging the guide pin in a connector assembly with the contacts 806. These contacts may be affixed to the plunger. The method further includes releasing the engagement mechanism 808, allowing the plunger to fixedly couple with the guide pin in the assembly. Then the apparatus may turn in a direction to tighten or loosen the guide pin within the assembly 810. Pressing the engagement mechanism disengages it from the guide pin 812.

Figure 9A:
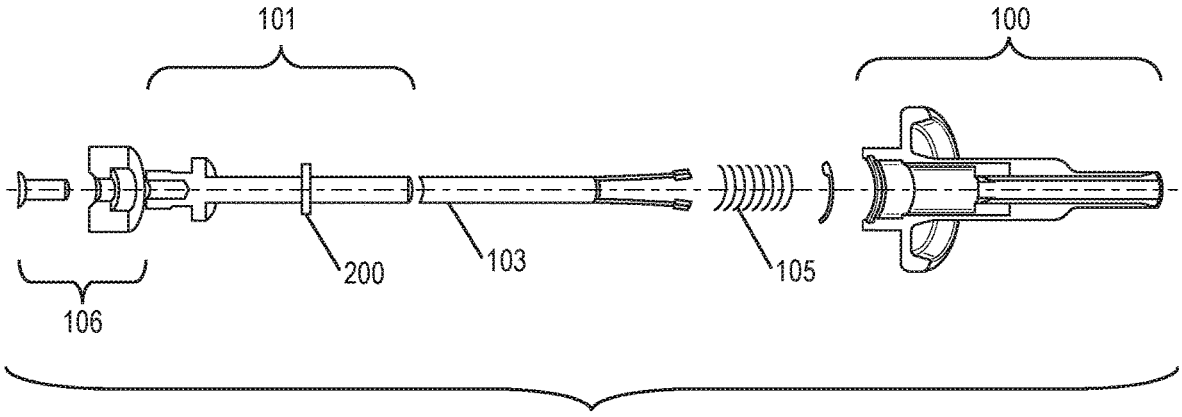
FIG. 9A shows a cut-away exploded view of the apparatus, according to an embodiment.
Figure 9B:
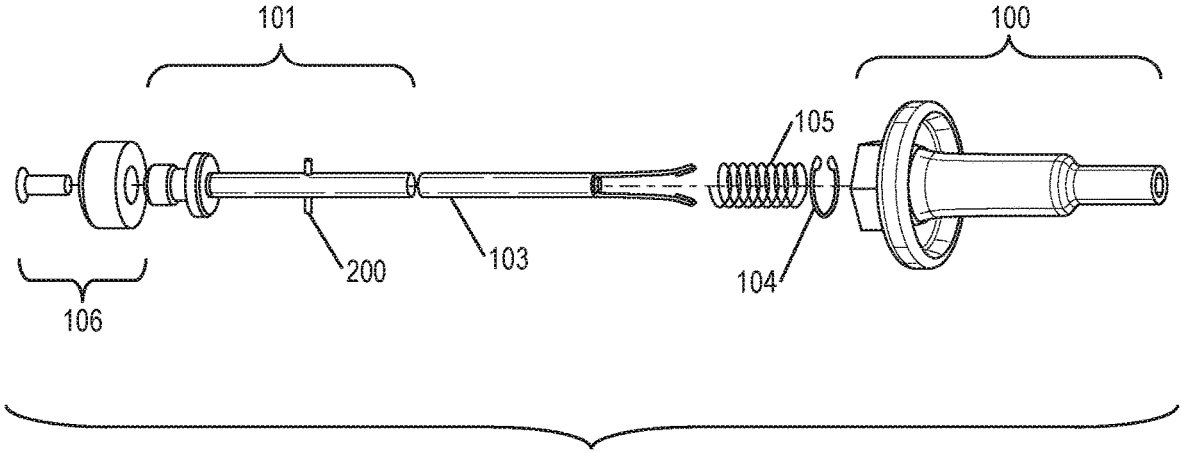
FIG. 9B shows an exploded view of the apparatus, according to an embodiment.

FIGS. 9A and 9B illustrate an exploded view of the present tool. The button 106 may be configured to couple with the second end of the plunger 101. The plunger 101 on one end is configured to fit within the support tube 103, where the coiled spring pin 200 runs through both the plunger 101 and the support tube 103 to ensure that the plunger 101 and coiled spring pin 200 remains in place. The compression spring 105 may wrap around the plunger 101, thereby allowing the compression spring 105 to engage with the coiled spring pin 200. The retainer clip 104 may help prevent the plunger 101 from coming out too far when it is released by preventing the plunger from coming out of the housing 100.

Figure 11A:
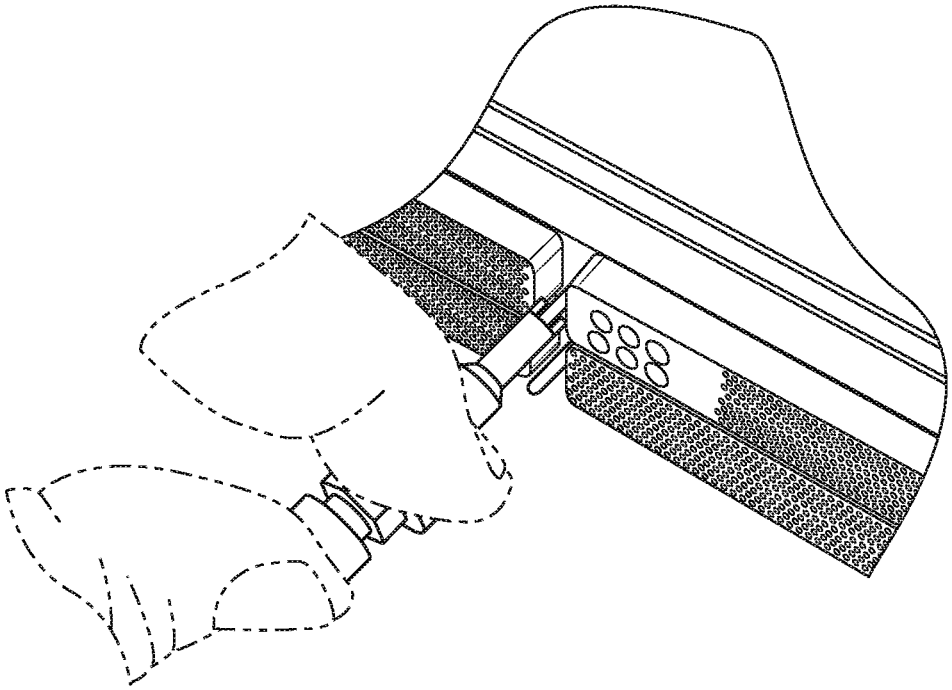
FIG. 11A is an image of the operation of the apparatus, according to an embodiment.
Figure 11B:
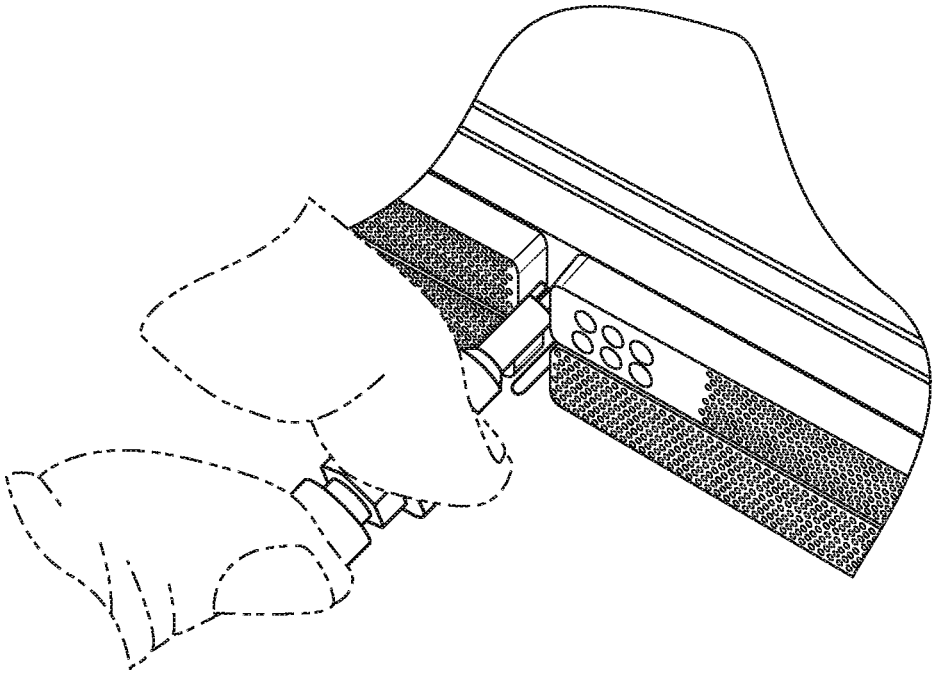
FIG. 11B is a further image of the operation of the apparatus, according to an embodiment.

FIGS. 10-12 are images showing the operation according to one embodiment. FIGS. 10A and 10B illustrates how a user may engage the apparatus 10 of the present disclosure and press the engagement mechanism 106 to extend the contacts 201, 202 of the support tube 103. When the contacts 201, 202 are extended, the apparatus 10 fits over the guide pin 1000 of the connector assembly 1002 such as an electronic module. FIGS. 11A and 11B illustrates how a user may slide the apparatus 10 over the guide pin in order to fit the apparatus 10 securely over the guide pin.

Figure 12A:
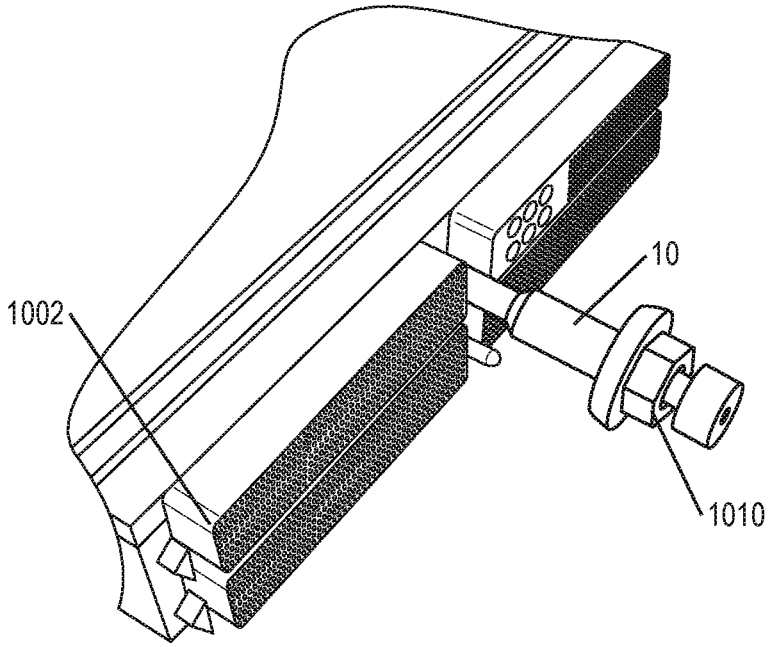
FIG. 12A is an image of the apparatus engaging a pin, according to an embodiment.
Figure 12B:
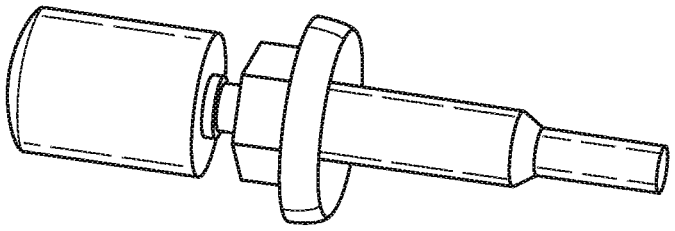
FIG. 12B is an image of the apparatus, according to an embodiment.

FIG. 12A illustrates the apparatus engaged with a guide pin of the electronic module 1002, where the engagement mechanism is released so that the apparatus is securely fit over the guide pin with the contacts gripping either side of the guide pin. In one example the apparatus includes a torque mating section 1010 that engages with a torque wrench so that the pin can be torqued to the proper level as prescribed in the manuals for the guide pins. The torque wrench (not shown) in this example slips onto the mating section 1010 which in this example is a hexagonal shape. The mating section can be square, hexagonal, star or similar shape to engage the torque wrench. FIG. 12B illustrates a different embodiment with the engagement mechanism or button having an elongated cylindrical shape.

During operation of one example, the user may place the device between the middle and index fingers on the gripping or extended portion and depress the button with a thumb to deploy two or more extensions using one hand that can be used to engage a guide pin. As the button is depressed, the plunger advances and the extensions extend from the housing. In one example the extensions include tapered contacts. The extensions are made to have an inherent outward pressure or memory shape that creates a separation between the contacts that allows the contacts to fit around the guide pin when extended. When the button is fully depressed, the apparatus is placed over the guide pin such that the extensions go around the pin and one end of the plunger contacts the head of the pin. As the button is released, the compression spring pulls the support tube extensions inwards across the open end of the housing that applies inward pressure to the extensions that thereby applies pressure to the guide pin. Once the pin is fully engaged, the user can remove or tighten the pin. In one example, a torque wrench is coupled to the apparatus and proper force is applied to the pin. To release the grip of the pin, the user depresses the button which extends the extensions that separate and release the grip on the pin.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

What is claimed is:

1. An apparatus for engaging a guide pin, comprising:
a housing having an interior section;
a plunger having a first end and a second end;
a support tube with two or more extensions, wherein a portion of the plunger at the first end fits within the support tube and wherein the support tube and plunger are substantially within the interior section of the housing;
an engagement mechanism coupled with a second end of the plunger;
a compression spring around the support tube and within a chamber of the housing;
a coiled spring pin positioned laterally through an aperture of the plunger, thereby allowing the coiled spring pin to keep the support tube and the plunger aligned; and
wherein the compression spring interacts with the coiled spring pin when the engagement mechanism causes the plunger to compress the compression spring against the coiled spring pin;
wherein the extensions are configured to engage the guide pin when the engagement mechanism is depressed and the extensions protrude from the housing.

2. The apparatus of claim 1, further comprising a gripping portion on the housing.

3. The apparatus of claim 1, further comprising a retainer clip on the second end of the plunger.

4. The apparatus of claim 1, wherein the second end of the plunger has a curved stop that contacts a top end of the guide pin.

5. The apparatus of claim 1, wherein the support tube is about 0.005 inches in diameter.

6. The apparatus of claim 1, wherein the extensions have contacts.

7. The apparatus of claim 6 wherein the contacts have a taper angle of about eight degrees.

8. The apparatus of claim 1, wherein the apparatus is configured to couple with torque wrenches or drivers.

9. The apparatus of claim 1, wherein the extensions have a memory shape in an outwards direction.

10. An apparatus for engaging a guide pin, comprising:
a housing wherein the housing contains a groove located inside the housing;
a plunger positioned within the housing, wherein the plunger has an aperture;
a support tube encasing a first end section of the plunger;
a compression spring wrapped around the plunger and support tube;
a coiled spring pin laterally extending through the aperture of the plunger, where the coiled spring pin is configured to engage with the compression spring, wherein the coiled spring pin sits within the groove located inside the housing;
a button coupled with a second end of the plunger, where the button is configured to engage with the plunger, the second end of the plunger further comprising a retainer clip wrapped around the second end of the plunger; and
at least two extensions at an end of the support tube, wherein the at least two extensions have a taper angle of about eight degrees
wherein the compression spring engages with the coiled spring pin when the button causes the plunger to compress the compression spring against the coiled spring pin.

11. The apparatus of claim 10, wherein the support tube is about 0.005 inches in diameter.

12. The apparatus of claim 10, wherein the apparatus is configured for use with torque wrenches or drivers.

13. A method for engaging a guide pin, comprising:
depressing an engagement mechanism of a tool, thereby depressing a plunger and extending two or more extensions of a support tube from a housing of the tool, where a compression spring compresses against a coiled spring pin;

engaging a guide pin in a connector assembly with the extensions;

releasing the engagement mechanism, where the plunger is substantially in contact with the guide pin;

rotating the tool in a direction; and pressing the engagement mechanism to disengage it from the guide pin.

14. The method according to claim 13, further comprising torqueing the guide pin to a proper level.

* * * * *